US006414273B1

(12) United States Patent
Taniguchi et al.

(10) Patent No.: US 6,414,273 B1
(45) Date of Patent: Jul. 2, 2002

(54) GLOW PLUG CONTROL APPARATUS, GLOW PLUG, AND METHOD OF DETECTING IONS IN ENGINE COMBUSTION CHAMBER

(75) Inventors: Masato Taniguchi; Masakazu Nagasawa; Hiroyuki Suzuki, all of Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/813,931

(22) Filed: Mar. 22, 2001

(30) Foreign Application Priority Data

Mar. 22, 2000 (JP) ..... 2000-079844
Mar. 2, 2001 (JP) ..... 2001-058157

(51) Int. Cl.[7] ..... F23Q 7/00
(52) U.S. Cl. ..... 219/270; 123/145 A
(58) Field of Search ..... 219/270, 544; 123/145 A, 145 R

(56) References Cited

U.S. PATENT DOCUMENTS 5,893,993 A * 4/1999 Kurano ..... 219/270
5,922,229 A * 7/1999 Kurano ..... 219/270
5,948,306 A * 9/1999 Konishi et al. ..... 219/270
6,150,634 A * 11/2000 Haussner et al. ..... 219/270
2001/0050275 A1 * 12/2001 Uhl ..... 219/270

FOREIGN PATENT DOCUMENTS

| | | | |
|---|---|---|---|
| JP | 10-9113 | | 1/1998 |
| JP | 10-73070 | * | 3/1998 |
| JP | 10-77945 | | 3/1998 |
| JP | 10-89227 | | 4/1998 |
| JP | 10-122114 | * | 5/1998 |

* cited by examiner

*Primary Examiner*—John A. Jeffery
(74) *Attorney, Agent, or Firm*—Morgan, Lewis & Bockius LLP

(57) ABSTRACT

In a glow plug controller, a glow plug 10 fixed to an engine 30 comprises a heater 4 and a ceramic substrate 2 having an exposed portion 2*d* which is exposed to the interior of a combustion chamber 32. A glow plug control apparatus 100 causes ECU 105 to control the energization of the heater 4 of the glow plug 10 to keep the surface temperature Ts of the exposed portion 2*d* to not lower than 500° C. Further, ionic current Ii is measured using the glow plug 10. Switches 102 and 103 switch from the energization of the glow plug to the detection of ionic current or vice versa in response to a command signal from ECU 105.

6 Claims, 11 Drawing Sheets

GLOW PLUG CONTROL APPARATUS, GLOW PLUG, AND METHOD OF DETECTING IONS IN ENGINE COMBUSTION CHAMBER

BACKGROUND OF THE INVENTION

1. Field of the Invention

The present invention relates to a glow plug control apparatus for controlling a glow plug so as to accelerate the ignition/combustion of a fuel by said glow plug or detect ions generated during the combustion of a fuel by said glow plug and a glow plug therefor.

2. Description of the Related Art

The recent trend is for more diesel engines having a high heat efficiency to be mounted on passenger cars for the purpose of enhancing fuel economy. Under these circumstances, the users have demanded further enhancement of fuel economy as well as further improvement of prevention of vibration or noise and actuation properties which are inferior to gasoline engine. On the other hand, from the standpoint of environmental protection, the exhaust gas has been demanded to be more clean.

In order to meet this demand, as disclosed in Japanese Patent Unexamined Publications No. Hei. 10-9113 and Hei. 10-77945, a feedback control has been proposed involving the use of results of detection of ions produced during the combustion of a fuel for the purpose of controlling the timing or amount of fuel injection in the engine. As a method of detecting ions there is particularly proposed a method involving the measurement of ionic current flowing due to the presence of ions produced by the application of a voltage across the glow plug and the inner wall of the combustion chamber of an engine.

Heretofore, a glow plug has played a role ranging from aiding actuation to stabilizing the engine drive until the completion of warming up and thus has normally not been energized after the completion of warming up. However, it has been made obvious that it is effective for the reduction of vibration or noise of the engine and purification of exhaust gas to energize the glow plug even after the warming-up of the engine so that the glow plug is kept at a relatively high temperature. A system has been proposed involving the energization of a glow plug depending on the operating conditions for the purpose of controlling the temperature of the glow plug to not lower than a predetermined temperature.

However, the above cited JP-A-10-9113 and JP-A-10-77945 merely disclose a system involving the energization of a glow plug before actuation (pre-glow period) and during the warming-up of the engine (after-glow period) and the use of the glow plug only for the detection of ionic current. In other words, the invention disclosed in the above cited patents cannot energize the glow plug even after the completion of warming-up to detect ionic current and control the engine. It is preferred that ionic current be detected to control the engine also in the stage before the completion of warming-up such as pre-glow period and after-glow period. However, when the system is arranged such that switching is made from the energization of the glow plug to the measurement of ionic current or vice versa during pre-glow period, particularly in the initial stage of energization of glow plug, it is likely that the temperature rise of the glow plug during pre-glow period can be delayed, deteriorating the actuation properties.

SUMMARY OF THE INVENTION

The present invention has been worked out in the light of the foregoing problems. An object of the present invention is to provide a glow plug control apparatus which can keep the temperature of the glow plug to not lower than a predetermined temperature even after the lapse of the stage after pre-glow period and the stage during the warming-up of an engine in addition to during these stages to lessen the vibration or noise of the engine and clean the exhaust gas and can detect ions produced during the combustion of a fuel to control the engine. Also, a glow plug suitable for the glow plug control apparatus and a method of detecting ions in the combustion chamber of an engine which has been warmed up are provided. Another object of the present invention is to provide a glow plug control apparatus which exhibits good actuation properties without deterring the temperature rise of the glow plug during pre-glow period.

To solve the foregoing problems, the present invention provide a glow plug control apparatus comprising a glow plug including a housing fixed to an engine, a heating element insulated from the housing which generates heat when energized by electric current supplied through two conductive paths at least either before or after the completion of warming-up of the engine and a ceramic heater having an exposed portion which is heated by the heating element and exposed to the interior of the combustion chamber of the engine; a glow plug energization controlling means for controlling the energization of the heating element of the glow plug depending on the surface temperature of the exposed portion so as to raise or keep the surface temperature to not lower than a predetermined temperature; an ion detecting means for detecting ions in the combustion chamber using the glow plug; a switching means for switching the state of the glow plug from the state of being controlled in energization by the glow plug controlling means to the state of being detected in ion by the ion detecting means or vice versa; and a switching command means for commanding the switching from the state of being controlled in energization to the state of being detected in ions by the switching means for a predetermined period of time from the time of injection of fuel into the combustion chamber when the surface temperature of the exposed portion is not lower than the predetermined temperature.

In accordance with the glow plug control apparatus of the invention, the glow plug energization controlling means controls such that the surface temperature of the exposed portion of the ceramic heater is raised or kept to not lower than a predetermined temperature. When the surface temperature of the exposed portion is not lower than the predetermined temperature, the switching command means commands the switching means to switch the state of being controlled in energization to the state of being detected in ions for a predetermined period of time from the time of injection of fuel.

For example, before the actuation of the engine, the glow plug is energized. The detection of ions is not conducted before the temperature thereof rises from a temperature as low as ordinary temperature to the predetermined temperature.

However, when the temperature of the glow plug reaches not lower than the predetermined temperature, the state of the glow plug is switched from the state of being controlled in energization to the state of being detected in ions for a predetermined period of time from the time of injection of a fuel into the combustion chamber. Accordingly, the detection of ions can be conducted in the internals of the rise of the temperature of the glow plug. Thus, engine control during actuation is made possible.

Thereafter, also in the stage of actuation and warming up of the engine, the surface temperature of the exposed portion of the glow plug is kept to the predetermined temperature at lowest, making it possible to detect ions. Accordingly, the engine control during warming-up can be conducted.

In accordance with the glow plug control apparatus, the surface temperature of the exposed portion of the glow plug is kept to the predetermined temperature at lowest even after the completion of warming-up. In this manner, the vibration and noise of the engine can be lessened and the exhaust gas can be cleaned. Further, ions produced by the combustion of the fuel can be detected, making it possible to control the engine.

The foregoing control may be conducted either before or after the completion of warming up of the engine. Accordingly, the foregoing control may be conducted at any time between pre-glow period before the actuation of the engine and after-glow period after the actuation of the engine and during the period after the completion of warming up.

Further, the foregoing control may be conducted at any time between before the actuation of the engine and before the completion of warming up. In this case, in the stage before the actuation of the engine, the detection of ions is not conducted before the temperature of the glow plug which has been energized reaches a predetermined temperature from a value as low as ordinary temperature. Therefore, the temperature of the glow plug can be raised without hindrance due to switching to the state of being detected in ionic current, giving favorable actuation properties. In this arrangement, similar control can be conducted even after the completion of warming up as mentioned above. Alternatively, control different from that made before the completion of warming up may be conducted after the completion of warming up.

Moreover, the foregoing control may be conducted at any time after the completion of warming up. In this case, after the completion of warming up, the surface temperature of the exposed portion of the glow plug can be not lower than the predetermined temperature. Therefore, the vibration and noise of the engine can be lessened and the exhaust gas can be cleaned. Further, ions produced by the combustion of the fuel can be detected, making it possible to control the engine.

Referring to the method of measuring the surface temperature of the exposed portion of the ceramic heater, a temperature sensor such as thermocouple may be embedded in the ceramic insulator. In this arrangement, the temperature of the exposed portion can be measured by means of such a temperature sensor such as thermocouple. Alternatively, since the resistivity of the heating element varies with temperature (normally rises as the temperature rises), the surface temperature of the exposed portion may be estimated from the resistivity of the heating element on the basis of previously determined relationship between the resistivity of the heating element and the surface temperature of the exposed portion.

The predetermined period of time from the time of injection of fuel commanded by the switching command means can be a predetermined value represented, e.g., by the crank angle from the time of injection of fuel. Further, the foregoing period of time from the time of injection of fuel is preferably selected depending on the load represented by the rotary speed of the engine, the opening of the accelerator, the position of the accelerator or the like. This is because the period of time during which ions can be detected to obtain data useful for engine control varies with the rotary speed of the engine or load.

The glow plug control apparatus may be arranged such that the foregoing predetermined temperature is selected from the range of from 500° C. to 900° C.

In the stage after the completion of warming up, when the glow plug is not energized, the surface temperature of the exposed portion of the glow plug varies with the rotary speed of the engine or the load conditions and thus falls within a range of from about 200° C. to 900° C. In other words, when the engine is rotated at a low speed under a low load, the surface temperature of the exposed portion of the glow plug may be lowered to about 200° C.

It is known that even if the engine is rotated at a low speed under a low load to give a low combustion temperature, when the glow plug is kept at a certain high temperature, the ignition and combustion of the fuel can be conducted in a stabilized manner, making it possible to effectively clean the exhaust gas and prevent the vibration and noise. Accordingly, the predetermined temperature of the invention is selected from a range of from 500° C. to 900° C. In other words, the glow plug should be kept at a predetermined temperature selected from a range of 500° C. to 900° C.

Referring to the reason why the predetermined temperature is selected from a range of from 500° C. to 900° C., when the predetermined temperature falls below 500° C., the resulting effect of stabilizing the ignition and combustion of the fuel in the engine is insufficient. On the contrary, when the predetermined temperature exceeds 900° C., the glow plug is kept at a high temperature. In other words, when control is conducted such that the temperature of the glow plug is kept beyond 900° C., the durability of the glow plug can be easily deteriorated. This is also because as the electric power consumed to energize the glow plug increases, the fuel economy lowers.

In the ceramic heater of the glow plug of the foregoing glow plug control apparatus, the heating element is covered by a ceramic substrate and the resistivity of the substrate between the heating element and the surface of the ceramic substrate is from 10 kΩ to 1 gΩ when the surface temperature of the exposed portion is from the predetermined temperature to 1,200° C.

The heating element of the ceramic heater used in the glow plug control apparatus is covered by a ceramic substrate and thus cannot be subject to corrosion or oxidation due to combustion flame. Thus, the ceramic heater is allowed to generate heat in a stabilized manner or the detection of ions can be conducted in a stabilized manner.

In order that ions in the combustion chamber can be detected by applying a voltage across the heating element embedded in the ceramic substrate and the inner wall of the combustion chamber in the state of being detected in ions, the resistivity of the ceramic substrate interposed therebetween must be somewhat low.

In this respect, the glow plug to be used in the glow plug control apparatus of the invention is arranged such that the resistivity between the heating element and the ceramic substrate is from 10 kΩ to 1 GΩ when the surface temperature of the exposed portion of the glow plug ranges from the predetermined temperature to 1,200° C. In this arrangement, ions can be detected within this temperature range.

The reason why the surface temperature of the exposed portion of the glow plug should fall within a range of from the predetermined temperature to 1,200° C. is that when the surface temperature of the exposed portion of the glow plug is not lower than the predetermined temperature, the state of the glow plug is switched to the state of being detected in ions for a predetermined period of time. Further, the surface temperature of the exposed portion of the glow plug may reach 1,200° C. at highest in the initial stage of actuation of engine.

The reason why the resistivity of the substrate should fall within a range of from 10 kΩ to 1 GΩ is that when the resistivity of the substrate is as extremely high as greater than 1 GΩ, the resulting ionic current is so extremely small that it can difficultly be detected. Accordingly, the resistivity of the substrate is preferably 1 GΩ or less. On the contrary, when the resistivity of the ceramic substrate is too low, current flows through the ceramic substrate across the two ends of the heating element to cause defects such as migration. Accordingly, the resistivity of the substrate is preferably 10 kΩ or more.

Another means for solving the foregoing problems is a glow plug control apparatus comprising a glow plug comprising a housing fixed to an engine, a heating element insulated from the housing which generates heat when energized by electric current supplied through two conductive paths at least either before or after the completion of warming-up of the engine and a ceramic heater having an exposed portion which is heated by the heating element and exposed to the interior of the combustion chamber of the engine; a glow plug energization controlling means for controlling the energization of the heating element of the glow plug depending on the resistivity of the heating element so as to raise or keep the resistivity to not lower than a predetermined resistivity; an ion detecting means for detecting ions in the combustion chamber using the glow plug; a switching means for switching the state of the glow plug from the state of being controlled in energization by the glow plug controlling means to the state of being detected in ions by the ion detecting means or vice versa; and a switching command means for commanding the switching from the state of being controlled in energization to the state of being detected in ions by the switching means for a predetermined period of time from the time of injection of fuel into the combustion chamber when the resistivity of the heating element is not lower than the predetermined resistivity.

There is often some relationship between the surface temperature of the exposed portion of the glow plug and the resistivity of the heating element. Instead of controlling by estimating the surface temperature of the exposed portion once from the resistivity of the heating element, similar control can be conducted by controlling the resistivity of the heating element within a range of not lower than a predetermined resistivity on the basis of the relationship.

In other words, in accordance with the foregoing glow plug control apparatus, the glow plug energization controlling means controls such that the resistivity of the heating element related to the surface temperature of the exposed portion of the ceramic heater is raised or kept to a predetermined resistivity or more. When the resistivity of the heating element is not lower than the predetermined resistivity, the switching command means commands that the switching means be switched from the state of being controlled in energization to the state of being detected in ions for a predetermined period of time from the time of injection of fuel.

Therefore, before the actuation of the engine, the glow plug is energized to raise the temperature thereof from a temperature as low as ordinary temperature to the predetermined temperature. In other words, the detection of ions is not conducted before the resistivity of the heating element reaches beyond the predetermined resistivity. However, when the temperature of the glow plug is not lower than the predetermined temperature, and the resistivity of the heating element thus reaches not lower than the predetermined resistivity, the state of the switching means is switched from the state of being controlled in energization to the state of being detected in ions for a predetermined period of time from the time of injection of fuel into the combustion chamber. Accordingly, the detection of ions can be conducted in the intervals of raising-up the temperature of the glow plug. Thus, engine control can be made also during actuation.

Further, in the subsequent stage of actuation and warming-up of engine, too, the resistivity of the heating element of the glow plug can be raised to a predetermined resistivity, that is, the surface temperature of the exposed portion can be raised to a predetermined temperature so that the detection of ions can be conducted. Accordingly, engine control can be made also during warming-up.

Moreover, even after the completion of warming-up, the resistivity of the heating element of the glow plug is raised to the predetermined resistivity, that is, the surface temperature of the exposed portion is raised to the predetermined temperature. In this manner, the vibration and noise of the engine can be lessened, and the exhaust gas can be cleaned. Further, ions produced by the combustion of the fuel can be detected, making it possible to control the engine.

The foregoing control may be conducted at least either before or after warming-up of the engine. Accordingly, the foregoing control may be conducted at any time between pre-glow period before the actuation of the engine and after-glow period after the actuation of the engine and during the period after the completion of warming up.

Further, the foregoing control may be conducted at any time between before the actuation of the engine and before the completion of warming up. In this case, in the stage before the actuation of the engine, the detection of ions is not conducted before the temperature of the glow plug which has been energized reaches a predetermined temperature from a value as low as ordinary temperature. Therefore, the temperature of the glow plug can be raised without hindrance due to switching to the state of being detected in ionic current, giving favorable actuation properties. In this arrangement, similar control can be conducted even after the completion of warming up as mentioned above. Alternatively, control different from that made before the completion of warming up may be conducted after the completion of warming up.

Moreover, the foregoing control may be conducted at any time after the completion of warming up. In this case, after the completion of warming up, the resistivity of the glow plug is not lower than the predetermined resistivity so that the surface temperature of the exposed portion can be raised to not less than the predetermined temperature. Therefore, the vibration and noise of the engine can be lessened and the exhaust gas can be cleaned. Further, ions produced by the combustion of the fuel can be detected, making it possible to control the engines A further means for solving the foregoing problems is a glow plug having a housing, and an heating element insulated from the housing which generates heat when energized by electric current supplied through two conductive paths, characterized in that the heating element has a ceramic heater covered by a ceramic substrate and the resistivity of the substrate between the heating element and the surface of the ceramic substrate is from 10 kΩ to 1 GΩ when the surface temperature of the forward end of the ceramic heater is from 500° C. to 1,200° C.

In the glow plug of the invention, the heating element is covered by a ceramic substrate and thus cannot be subject to corrosion or oxidation due to combustion flame. Thus, the ceramic heater is allowed to generate heat in a stabilized manner.

Further, in the glow plug of the invention, when the surface temperature of the forward end of the ceramic heater is from 500° C. to 1,200° C., the resistivity of the substrate between the heating element and the surface of the ceramic substrate is from 10 kΩ to 1 GΩ. In this arrangement, while the surface temperature of the ceramic substrate is kept to this range, the detection of ions can be conducted. Further, by keeping the surface temperature of the ceramic substrate to not lower than 500° C., the ignition and combustion of fuel can be conducted in a stabilized manner, making it possible to lessen the vibration or noise of the engine and clean the exhaust gas.

A still further means for solving the problems is a method of detecting ions in the combustion chamber of an engine to which a glow plug is fixed, the glow plug comprising a housing, an heating element insulated from the housing which generates heat when energized by electric current supplied through two conductive paths and a ceramic heater having an exposed portion which is heated by the heating element and exposed to the interior of the combustion chamber. In the method, while the engine is being warmed up, the energization of the heating element of the glow plug is controlled depending on the resistivity of the heating element so as to raise or keep the resistivity to not lower than a predetermined resistivity and when the resistivity of the heating element is not lower than the predetermined resistivity, the state of the glow plug is switched from the state of being controlled in energization for a predetermined period of time from the time of injection of fuel into the combustion chamber during which period ions in the combustion chamber are detected.

In accordance with the method for detecting ions in the combustion chamber of an engine, energization is controlled in the stage of completion of warming-up of engine such that the resistivity of the heating element is raised or kept to not lower than a predetermined resistivity. In other words, energization is conducted to generate heat such that the surface temperature of the exposed portion of the ceramic heater reaches a predetermined temperature. Accordingly, even after the warming-up of the engine, the vibration or noise of the engine can be lessened and the exhaust gas can be cleaned.

Further, switching is made to the state of being controlled in energization, whereby the detection of ions in the combustion chamber is conducted using the glow plug. In this manner, ions produced during the combustion of fuel can be detected to help control the timing or amount of injection of fuel into the engine.

It may be arranged such that the detection of ions is conducted even while the warming-up of the engine is not completed yet.

DETAILED DESCRIPTION OF THE PREFERRED EMBODIMENT

Figure 1:
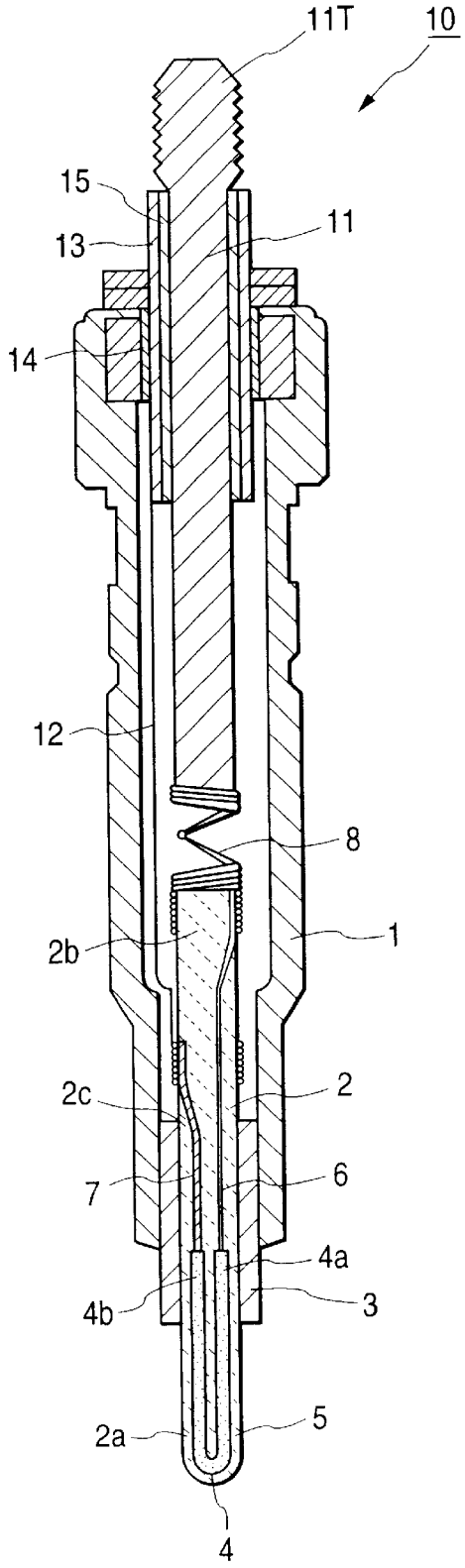
FIG. 1 is a sectional view of a glow plug.

A first embodiment of the glow plug and glow plug control apparatus according to the invention will be described in connection with the attached drawings. A glow plug 10 shown in FIG. 1 has a metallic cylindrical housing 1 and a ceramic heater 2. The ceramic heater 2 is brazed to an outer metallic cylinder 3 with its forward end (lower end as shown in the drawing) exposed to the exterior. The outer cylinder 3 is brazed to the housing 1.

The ceramic heater 2 has a U-shaped ceramic heating element (heating element) 4, a ceramic substrate 5 covering the ceramic heating element 4, and two leads 6, 7 made of tungsten through which the two ends 4*a*, 4*b* of the ceramic heating element 4 are connected to the exterior, respectively. Among these components, the ceramic substrate 5 is made of a ceramic mainly composed of silicon nitride having titanium carbide as an electrically-conductive ceramic incorporated therein in a small amount. The ceramic substrate 5 stays to be an insulator at ordinary temperature but lowers in resistivity and shows electrical conductivity as the ambient temperature rises. Silicon nitride shows a gradual drop of insulation resistance with the rise of temperature. When silicon nitride has an electrically-conductive ceramic incorporated therein as in the ceramic substrate 5, the substrate resistivity (insulation resistance) shows a change to a lower value than that of silicon nitride. The ceramic heating element 4 is an electrically-conductive ceramic made of the ceramic material used in the ceramic substrate 5 and tungsten carbite (WC).

The end 4*a* of the ceramic heating element 4 is connected to the rear end (upper end as shown in the drawing) of the ceramic heater 2 through the lead 6 and then to a center wire 11 through a coil spring-shaped lead 8. The center wire 11 has its forward end (upper end as shown in the drawing)

externally threaded to form a terminal portion 11T. On the other hand, the other end 4*b* of the ceramic heating element 4 is connected to the periphery of the central part 2*c* of the ceramic heater 2 through the lead 7 and then to a terminal sleeve 13 surrounding the longitudinally central portion of the center wire 11. The terminal sleeve 13 is insulated from the housing 1 by a cylindrical insulating ring 14 and also from the center wire 11 by a cylindrical insulating sleeve 15 provided along the inner wall of the terminal sleeve 13.

Accordingly, the glow plug 10 is arranged such that when an electric current is allowed to flow between the center wire 11 (terminal portion 11T) and the terminal sleeve 13, the ceramic heating element 4 generates heat, causing the surface temperature of the forward end 2*a* of the ceramic heater 2 to rise. Thus, the ceramic heating element 4 is insulated from the housing 1.

In the ceramic heater 2, the ceramic heating element 4 is covered by the ceramic substrate 5. The ceramic substrate 5 is made of a material which becomes electrically conductive at elevated temperatures as mentioned above. Thus, when the ceramic heating element is energized to cause the temperature of the ceramic substrate to rise, the resistivity between the ceramic heating element 4 and the surface of the ceramic substrate 5 lowers. Accordingly, as described later, the glow plug 10 can be used as a heat source before the actuation of the engine or in the stage of after-glow. Further, by keeping the glow plug 10 at a high temperature, ions produced between the ceramic insulating element 4 and the engine during the combustion of fuel can be detected through the ceramic substrate 5.

The relationship between the resistivity Rg of the ceramic heating element 4 of the glow plug 10, the surface temperature Ts of the forward end 2*a* and the resistivity Ri between the ceramic heating element 4 and the surface of the forward end 2*a* of the glow plug 10 was examined as follows Firstly, the forward end 2*a* of the glow plug 10 is covered by an electrically-conductive metal film. In some detail, gold or silver was vacuum-evaporated onto the forward end 2*a* of the glow plug 10 to a thickness of about 1 $\mu$m. This is intended to make it possible to measure the substrate resistivity Ri between the ceramic heating element 4 and the forward end 2*a* of the glow plug 10 in a stabilized manner.

Figure 2:
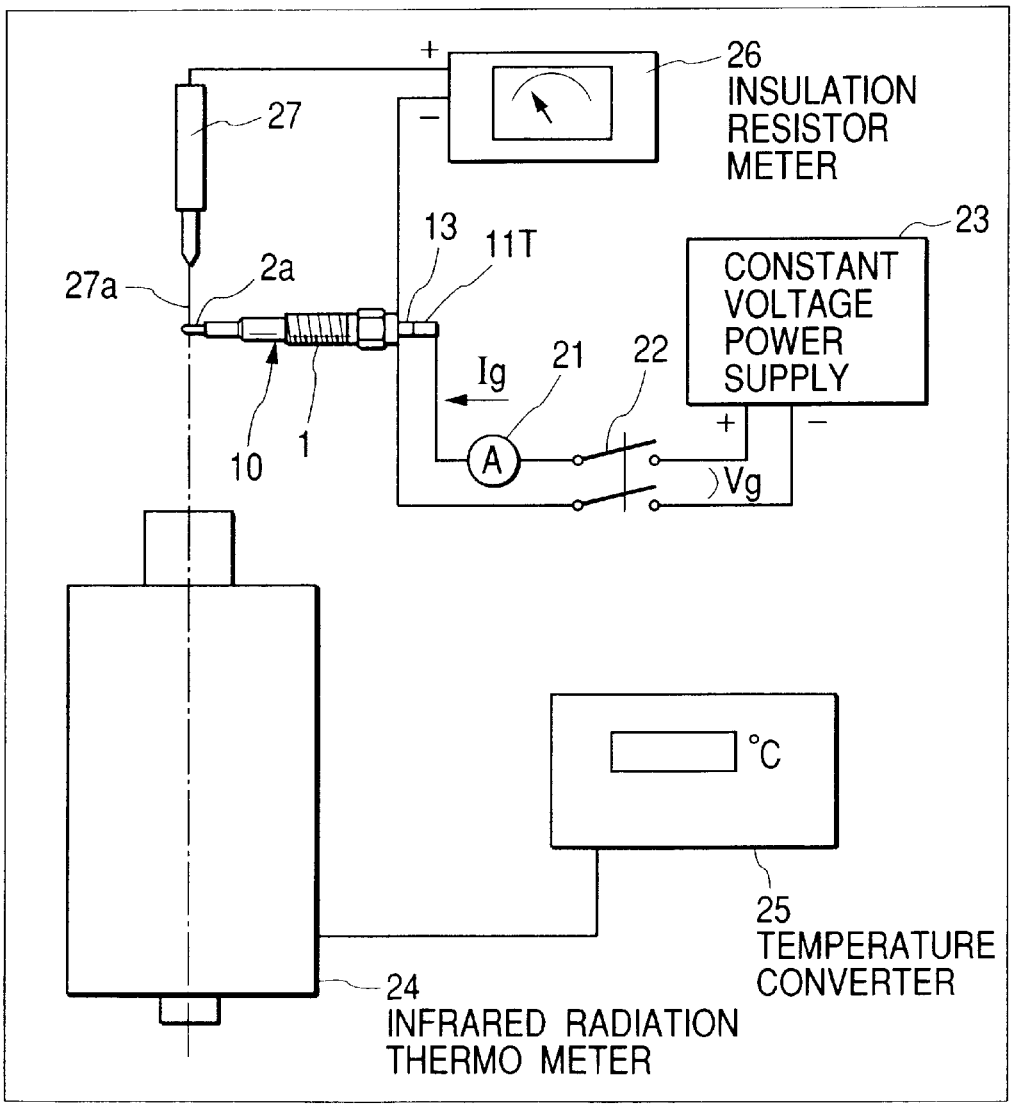
FIG. 2 is a diagrammatic view illustrating a method of measuring the surface temperature Ts, the heating element resistivity Rg and the substrate resistivity Ri of the ceramic substrate of the glow plug.

Subsequently, as shown in FIG. 2, a constant voltage power supply 23 is connected between the terminal portion 11T and the terminal sleeve 13 of the glow plug 10 via an ammeter 21 and a switch 22. In this arrangement, a constant voltage vg of 12 V is supplied from the constant voltage power supply 23 to the glow plug 10 so that the ceramic heating element 4 generates heat to cause the temperature of the forward end 2*a* of the glow plug 10 to rise. As the constant voltage power supply there was used a Type PVS20-130 power supply produced by KIKUSUI CO., LTD. In this manner, the heating element resistivity Rg (=Ig/vg) of the glow plug 10 (ceramic heating element 4) can be calculated from the applied voltage Vg and the current Ig flowing through the ammeter 21.

On the other hand, in order to know the surface temperature Ts of the forward end 2*a,* the temperature of the area on the forward end 2*a* having the highest surface temperature is measured by an infrared radiation thermometer 24 arranged to cover the region containing the forward end 2*a*. The surface temperature Ts is indicated by a temperature converter 25. As the infrared radiation thermometer 24 there was used TVS-100 produced by Nippon Avionics Co., Ltd.

The ceramic heating element 4 rises in its resistivity as the temperature rises. Accordingly, when the relationship between the surface temperature Ts of the forward end 2*a* and the resistivity Rg of the glow plug 10 is known, the heating element resistivity Rg of the glow plug can be determined from the voltage Vg applied to the glow plug 10 and the current Ig flowing at this time even if the glow plug 10 is mounted on the engine. In this manner, the surface temperature Ts of the forward end 2*a* can be estimated.

Further, the forward end 27*a* of the probe 27 of an insulation resistance meter 26 is brought into contact with the forward end 2*a* of the glow plug 10 to measure the substrate resistivity Ri between the terminal sleeve 13 and the forward end 27*a*. In this manner, the substrate resistivity Ri between the ceramic heating element 4 and the surface of the ceramic substrate 5 can be measured. The forward end 2*a* has a metal film such as gold layer formed thereon as mentioned above, making it possible to measure the substrate resistivity Ri in a stabilized manner without being affected by the contact conditions of the probe 27. As the forward end 27*a* of the probe 27 there is used an iron member in the form of column having a diameter of 0.1 mm to make it difficult for heat on the forward end 2*a* to escape. As the insulation resistance meter 26 there was used R8340 (ULTRA HIGH RESISTANCE METER) produced ADVANTEST.

In this manner, the relationship between the surface temperature Ts of the forward end 2*a* and the substrate resistivity between the ceramic heating element 4 and the surface of the ceramic substrate 5 can be known.

Besides the glow plug 10 according to the present embodiment, those having varied compositions of ceramic substrate 5 were prepared in the same manner as mentioned above. These samples were then measured in the same manner as mentioned above. The formulation of these samples are set forth in Table 1. The glow plug 10 according to the present embodiment comprises the ceramic substrate 5 having the formulation B.

TABLE 1

| Type | % by mass of silicon nitride | % by mass of sintering aid | % by mass of electrically-conductive ceramic | |
|---|---|---|---|---|
| A | 90 | 8 | TiN | 2 |
| B | 85 | 10 | TiC | 5 |
| C | 80 | 12 | WC | 8 |
| D | 75 | 15 | $MoSi_2$ | 10 |
| E | 70 | 17 | SiC | 13 |

Sintering aid: $10Yb_2O_3 + 1Cr_2O_3$

Figure 3:
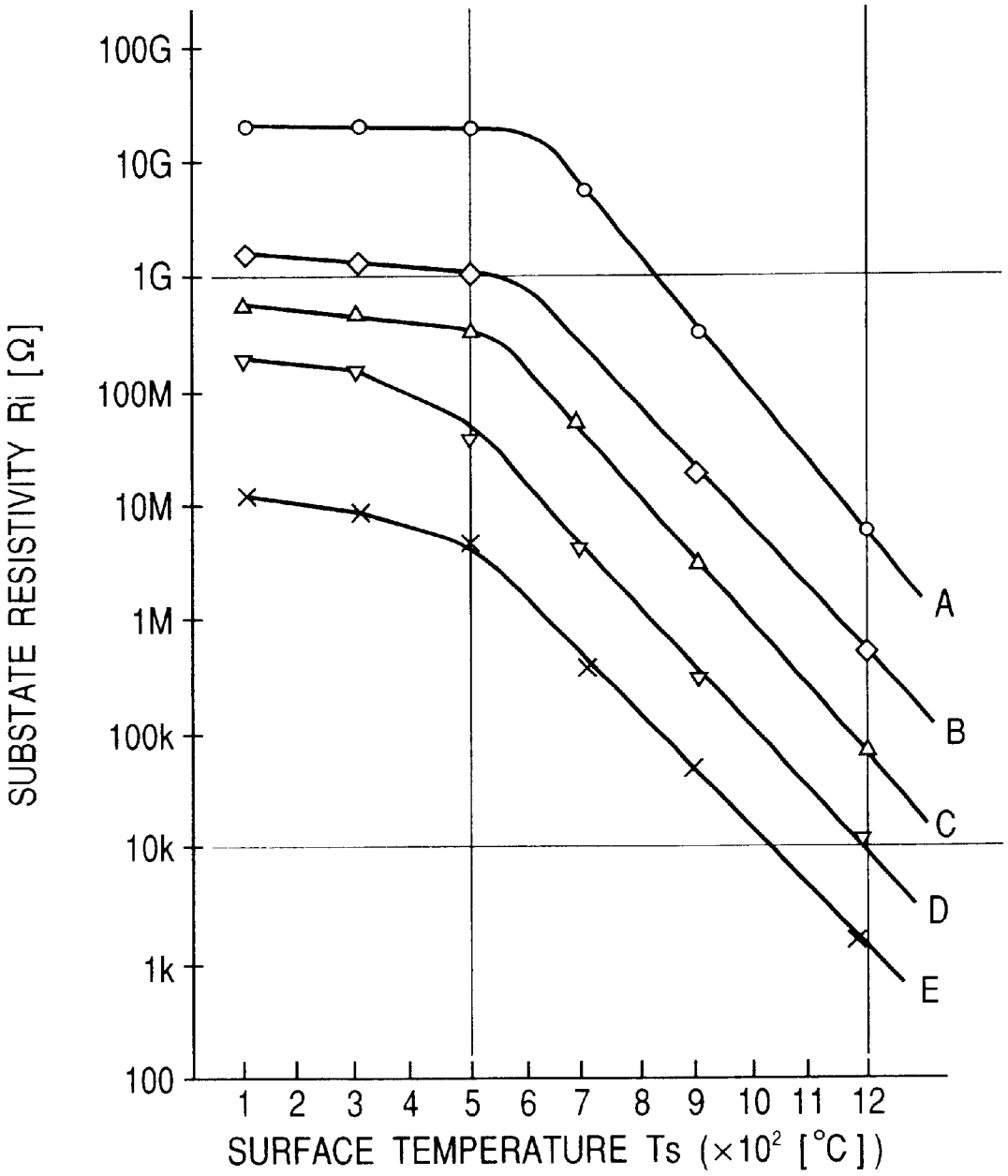
FIG. 3 is a graph illustrating the relationship between the surface temperature Ts and the substrate resistivity Ri of various ceramic substrates of glow plug.

The foregoing measurements of the glow plugs 10 comprising these formulations of ceramic substrate 5 are shown in FIG. 3. As can be easily appreciated from this graph, all the compositions lower in substrate resistivity Ri as the surface temperature Ts of the forward end 2*a* rises. It can be also seen that the more the added amount of an electrically-conductive ceramic such as TiN, TiC, WC, $MoSi_2$ and SiC, the bigger is the drop of the substrate resistivity Ri.

Figure 4:
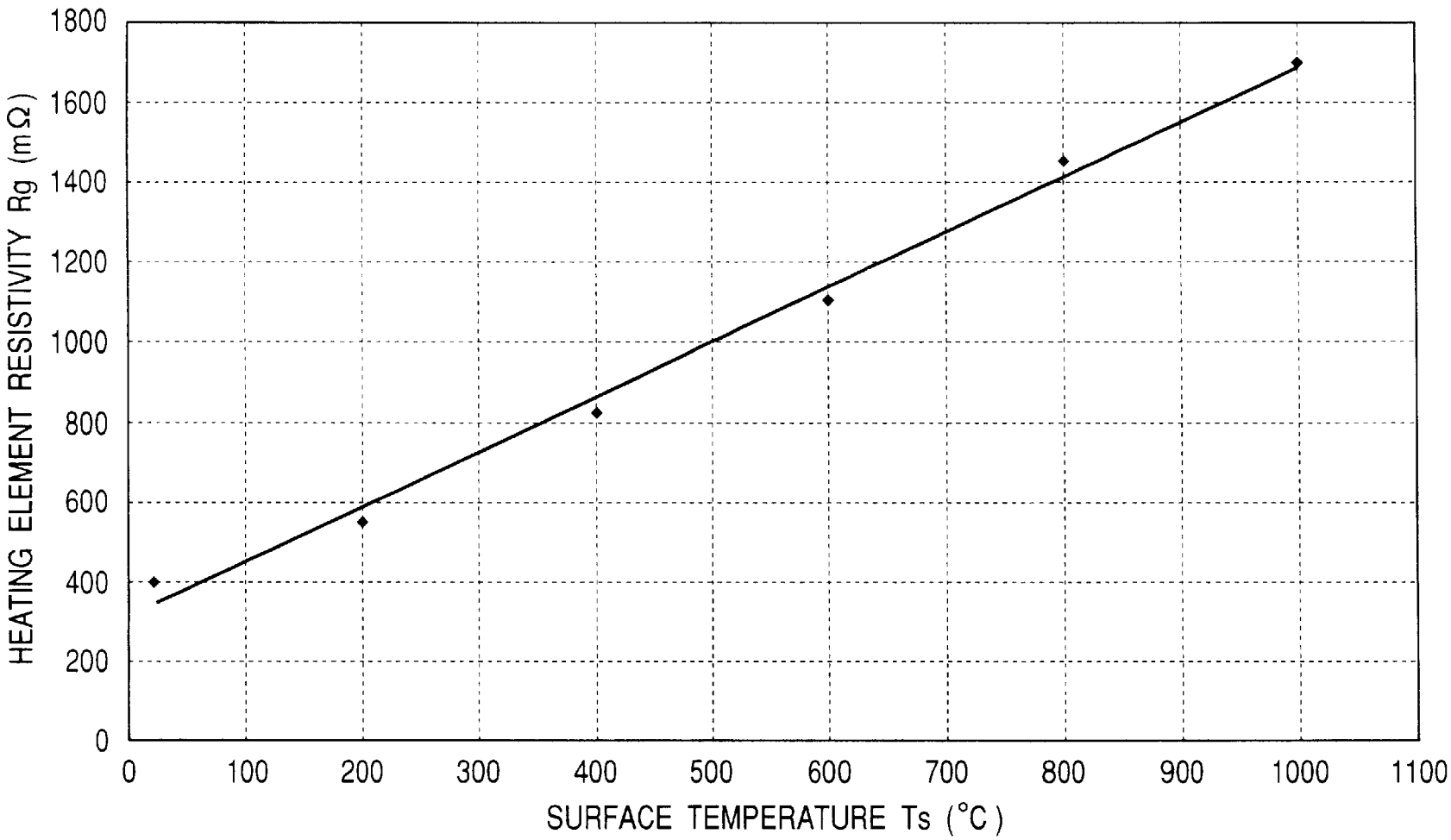
FIG. 4 is a graph illustrating the relationship between the surface temperature Ts of the ceramic substrate and the resistivity Rg of the ceramic heating element.

The relationship between the surface temperature Ts of the exposed portion and the resistivity Rg of the ceramic heating element is shown in FIG. 4. As can be easily appreciated from this graph, as the surface temperature Ts rises, the heating element resistivity Rg shows a monotonous linear increase. Accordingly, by knowing the heating element resistivity Rg, the surface temperature Ts can be estimated on the basis of this graph. The five glow plugs showed similar relationship between the surface temperature Ts and the heating element resistivity Rg. This is because the five glow plugs comprised similar ceramic heating element 4.

The glow plug 10 to be used in the present embodiment may be prepared by any conventional method. For example, the ceramic heater 2 may be prepared as follows. In some detail, an uncalcined ceramic heating element 4 to which leads 6, 7 made of tungsten wire are attached is formed by injection molding. This ceramic heating element 4 is made of a blend of 60% by mass of tungsten carbide (WC) and 40% by weight of a ceramic having the formulation B set forth in Table 1 above. Separately, a half-solidified uncalcined ceramic substrate 5 has been prepared by press-molding a ceramic powder having the formulation B. Thereafter, the uncalcined ceramic heating element 4 and the leads 6, 7 are disposed in the uncalcined ceramic substrate 5, hot-pressed, and then subjected to grinding or the like to obtain the ceramic heater 2.

Figure 5:
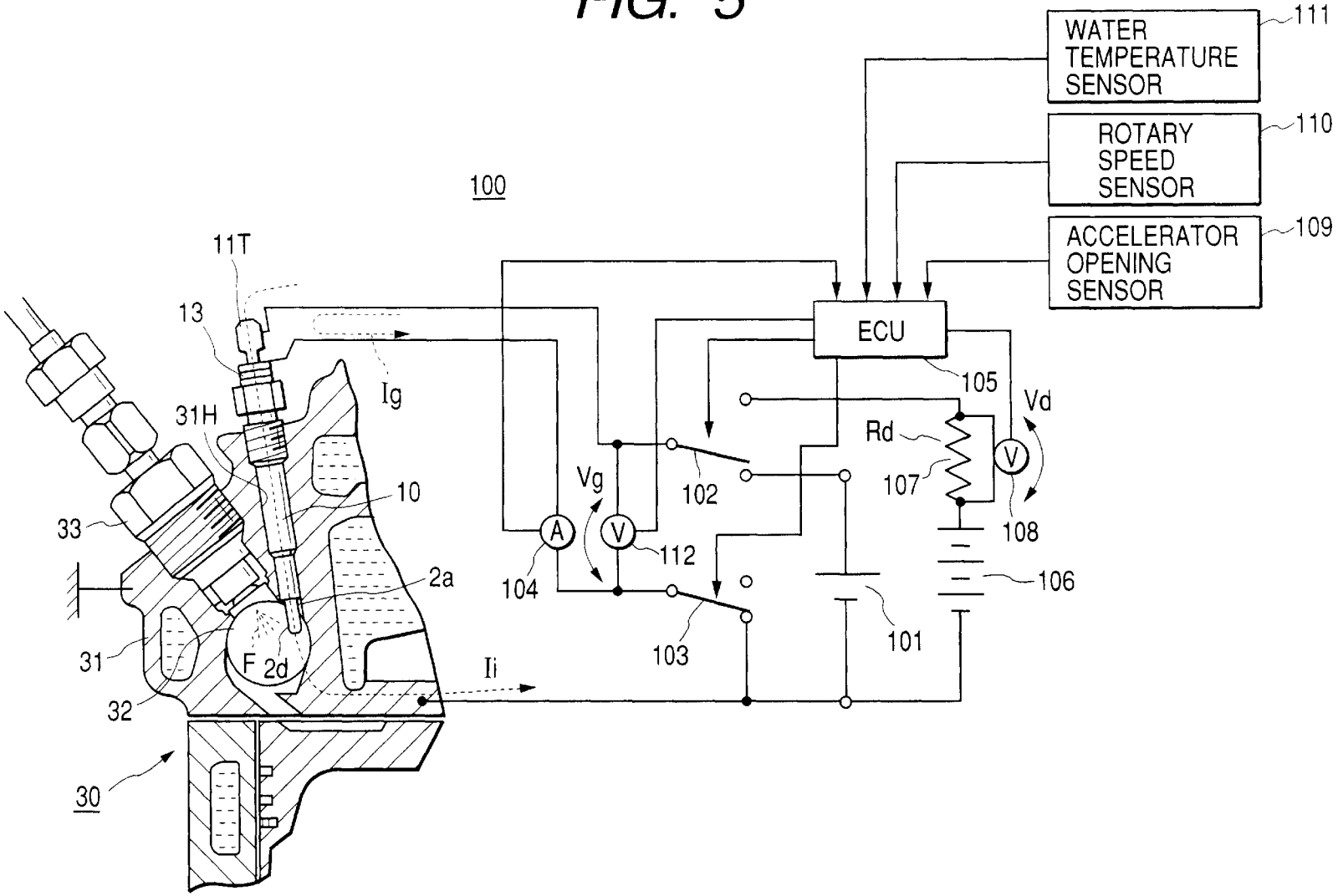
FIG. 5 is a diagrammatic view illustrating how the glow plug is mounted on the engine and the outline of the glow plug control apparatus.

The outline of the glow plug control apparatus 100 according to the present embodiment is shown in FIG. 5. The glow plug 10 already described is threaded in a mounting hole 31H formed in the cylinder head 31 of the engine 30 and has the forward end 2*a* of the ceramic heater 2 exposed in a subsidiary combustion chamber 32 provided in the cylinder head 31. The exposed portion 2*d* acts as a heat source for accelerating the ignition and combustion of a fuel F which has been injected from a fuel injection valve 33.

A circuit for controlling the energization of the ceramic heating element 4 of the glow plug 10 (glow plug energization circuit) will be described hereinafter. As shown in FIG. 5, the positive electrode of a battery 101 having an electromotive voltage vg of 12 V is connected to the terminal portion 11T of the glow plug 10 via a switch 102. On the other hand, the terminal sleeve 13 is connected to the negative electrode of the battery 101 via an ammeter 104, a switch 103 and the vehicle body. The switches 102 and 103 can open or close the circuit in response to a command signal from an electronic controller (hereinafter also referred to as "ECU"). As such a switch there may be used a switch comprising a power controlling electronic element such as transistor, FET and thyristor or a switch circuit comprising these elements.

By switching the switch 102 to the battery 101 (lower side as shown in the drawing) and switching the switch 103 ON (circuit closed), the battery 101 supplies current Ig to cause the ceramic heating element 4 of the glow plug 10 to generate heat. By allowing ECU 105 to properly control ON/OFF of the switch 103,the energization of the glow plug can be controlled. In other words, current Ig flowing through the ceramic heating element 4 can be varied. In this manner, the generation of heat by the ceramic heating element 4, i.e., surface temperature Ts of the forward end 2*a* (exposed portion 2*d*) can be controlled.

The voltage Vg across the terminal 11T and the terminal sleeve 13 can be measured by a voltmeter 112.The output Vg of the voltmeter 112 and the output Ig of the ammeter 104 are inputted to Ecu 105. The heating element resistivity Rg of the glow plug 10 (=Vg/Ig) is then calculated. The surface temperature Ts of the forward end 2*a* (exposed portion 2*d*) of the glow plug 10 is then estimated and calculated from the heating element resistivity Rg. The surface temperature Ts may be estimated from the heating element resistivity Rg on the basis of the graph shown in FIG. 4. In some detail, Ts is calculated using the relationship between Rg and Ts represented by the formula of regression line (regression linear line in the present embodiment) drawn in the graph. Alternatively, Ts may be obtained from previously stored table data of relationship between Rg and Ts.

A circuit for measuring ionic current using the glow plug 10 (ionic current measuring circuit) will be described hereinafter. The positive electrode of a constant voltage power supply 106 having an output voltage of 300 V is connected to the terminal portion 11T of the glow plug 10 via a detection resistor 107 having a resistivity Rd (=100 kΩ) and the switch 102 while the negative electrode of the power supply 106 is connected to a cylinder head 31 via the vehicle body.

Accordingly, by switching the switch 102 to the constant voltage power supply 106 (upper side as shown in the drawing) and switching the switch 103 Off (circuit opened), the ceramic heating element 4 of the glow plug 10 is at a positive potential with respect to the vehicle body, i.e., cylinder head 31. Therefore, when the fuel F is combusted to generate ions, positive ions are attracted to the wall of the cylinder head 31 while negative ions are attracted to the exposed portion 2*d* of the glow plug 10.

When the forward end 2*a* is at so high a temperature that the ceramic substrate 5 lowers in insulation resistance and becomes somewhat electrical conductive, ionic current Ii can be measured via the ceramic substrate 5. By measuring the voltage Vd across the detection resistor 107 by the voltmeter 108, ionic current Ii can be detected. The output of the voltmeter 108 is inputted to ECU 105.

When the resistivity Ri of the ceramic substrate 5 is too great, the resulting ionic current Ii is extremely small. Thus, the voltage Vd across the detection resistor 107 becomes small and is concealed in noise, making it difficult to detect ionic current Ii. The resistivity Ri of the ceramic substrate is preferably not higher than 1 GΩ, more preferably not higher than 500 MΩ, even more preferably not higher than 100 kΩ.

Though not shown in detail, ECU 105 comprises a microprocessor, ROM for storing predetermined programs and data, RAM for temporarily storing data, known microcomputer comprising input/output circuit, etc., A/D conversion circuit, etc. ECU 105 uses the detection timing or waveform of ionic current Ii to control the time or amount of injection of fuel from the fuel injection valve 33. ECU 105 also receives various data from an accelerator opening sensor 109 for indicating load L on the engine 30, a rotary speed sensor 110 for detecting the rotary speed Nr of engine or a water temperature sensor 111 for detecting the temperature Tw of cooling water in the engine 30 to perform controlling. ECU 105 performs main routine according to program stored in ROM. ECU 105 also performs switching between energization of glow plug and detection of ionic current (see FIG. 8) as described later by interrupt.

Figure 6:
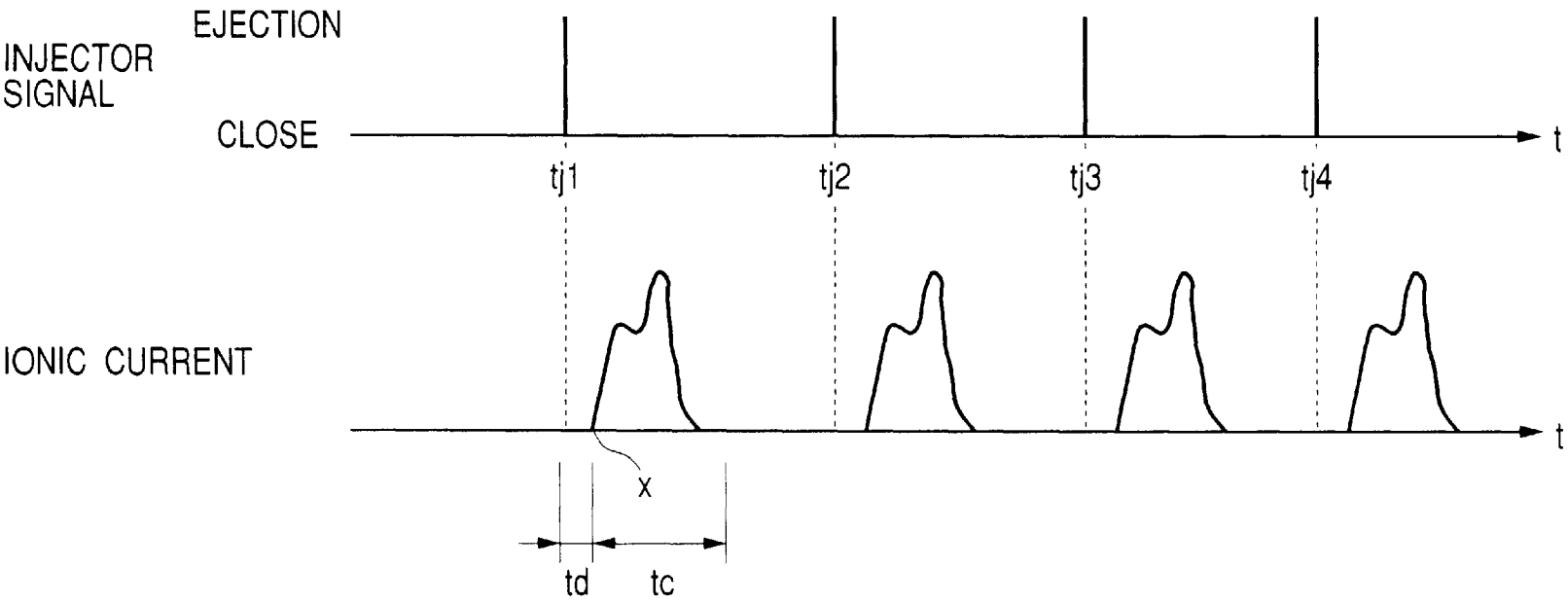
FIG. 6 is a diagram illustrating an example of the waveform of ionic current and the relationship with the timing of fuel injection.

An example of the waveform of this ionic current Ii is shown in FIG. 6. Explaining the ionic current Ii shown in this example, it rises with a some time lag td from the input timing (time of injection of fuel) tj1, tj2, tj3, tj4 . . . in the injection signal commanding the fuel injection valve 33 to eject fuel. Thus, the waveform of ionic current Ii has a first peak followed by a second peak which is somewhat larger than the first peak. Since the time X of rise of ionic current Ii corresponds to the time of ignition of the fuel F, the time of ignition can be known from the ionic current Ii. Accordingly, by making feedback control over the time or amount of injection of fuel such that the desired ignition time is attained on the basis of the ignition time detected, the engine can be controlled. The conditions of combustion in the cylinder can be known also from the height of wave or peak position obtained from the waveform of ionic current or the area (integrated value) obtained from the waveform of ionic current.

Figure 7:
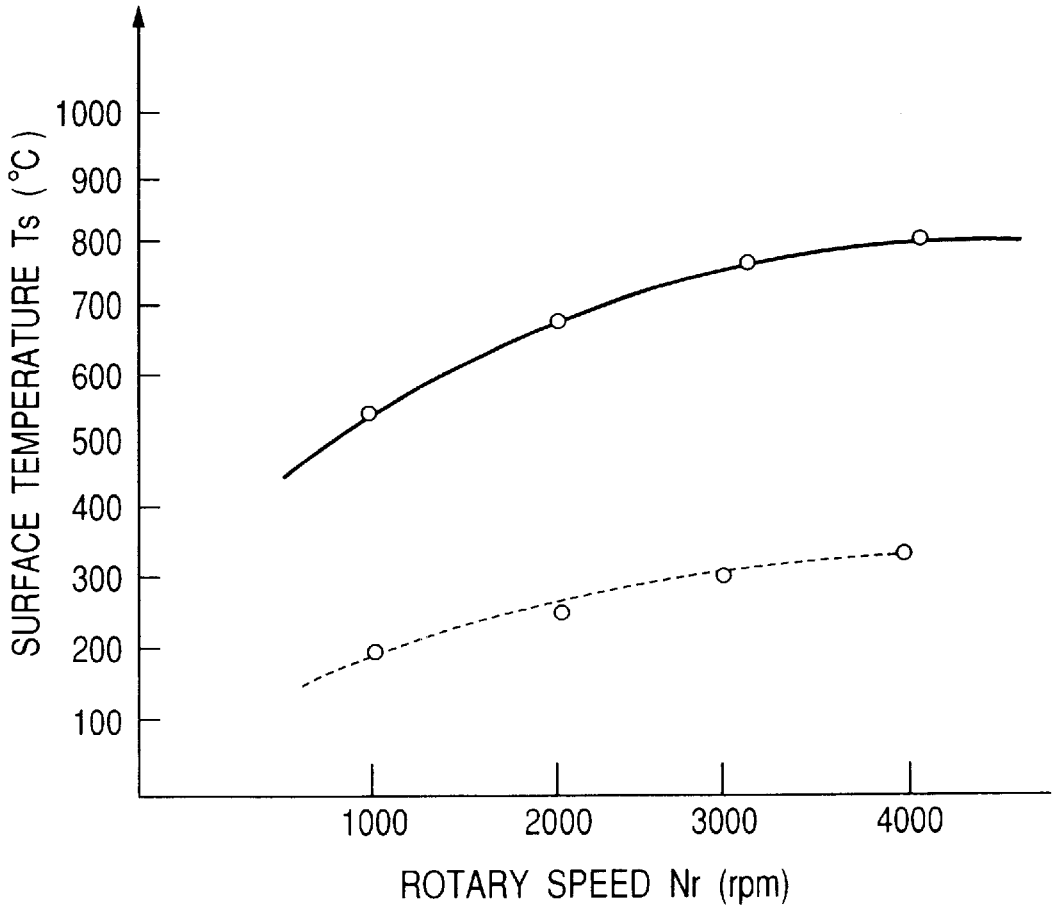
FIG. 7 is a graph illustrating the relationship between the engine rotary speed and the surface temperature of the glow plug under the conditions that the glow plug is not energized.

Subsequently, the engine 30 was actuated and warmed up. The engine 30 was then operated at a predetermined rotary speed Nr while the glow plug 10 was not energized. The surface temperature Ts of the forward end 2*a* of the glow plug 10 at this time was then estimated from the resistivity Rg of the ceramic heating element 4. The relationship between the engine rotary speed Nr and the surface temperature Ts is shown in FIG. 7. The results are shown with two parameters, i.e., unloaded (L=0/4) and totally loaded (L=4/4).

As can be easily appreciated from this graph, the surface temperature Ts of the forward end 2*a* (exposed portion 2*d*) of the glow plug 10 rises as the rotary speed Nr increases. Further, the greater the load L is, the higher is the surface temperature Ts.

As previously mentioned, it is known that by keeping the temperature of the forward end 2*a* of the glow plug 10 high even after the completion of warming-up, the ignition and combustion of fuel in the engine can be stabilized, exerting an effect of lessening the vibration and noise of the engine and clean the exhaust gas. The surface temperature Ts at which such an effect can be explicitly exerted is not lower than 500° C. Accordingly, as can be seen in the graph of FIG. 7, when the engine is operated at a low rotary speed or under a low load, the glow plug 10 is preferably energized to raise the surface temperature Ts of the forward end 2*a* to not lower than 500° C.

Referring again to the graph of FIG. 3, the glow plug 10 to be used in the glow plug control apparatus 100 is preferably arranged such that the resisitivity Ri of the ceramic substrate is not higher than 1GΩ when the surface temperature Ts is not lower than 500° C. as mentioned above.

On the other hand, when the substrate resistivity Ri is as extremely small as lower than 10 kΩ, electric current flows through the ceramic substrate 5 across the two ends 4*a*, 4*b* (see FIG. 1) of the ceramic heating element 4, possibly causing migration. Accordingly, Ri is preferably not lower than 10 kΩ. The glow plug 10 momentarily rises to about 1,400° C. but normally rises to about 1,200° C. at highest. Since migration gradually occurs, it is considered that Ri may be not lower than 10 kΩ when Ts is not higher than 1,200° C.

As can be seen in the foregoing description, a glow plug having characteristics falling within the substrate resistivity Ri range of from 10 kΩ to 1 GΩ at a surface temperature Ts range of from 500° C. to 1,200° C. as encompassed by four straight lines in FIG. 3. It is made obvious that preferred among the five formulations A to E set forth in Table 1 are three formulations, i.e., B (present embodiment), C, and D.

As previously mentioned, when the added amount of the electrically-conductive ceramic such as TiN and TiC is increased, the resisitivity Ri of the ceramic substrate 5 can be lowered, making it easy to detect ionic current.

However, the more the electrically-conductive ceramic is added, the lower is durability, heat resistance or corrosion resistance. This is presumably because the electrically-conductive ceramic has a lower durability, heat resistance and corrosion resistance than silicon nitride. By way of example, the glow plugs comprising the ceramic substrate 5 having the foregoing formulations A to E were each subjected to energization durability test involving 30,000 repetition of cycle consisting of 1 minute of energization (momentary highest temperature of forward end: 1,400° C.) and 1 minute of suspension of energization (air-cooled until ordinary temperature is reached). As a result, the glow plugs having the formulations A to D showed no abnormality. However, the glow plug having the formulation E showed cracking at 6,000th to 8,000th cycle.

Thus, it is not preferred that the added amount of the electrically-conductive ceramic is excessively increased. Accordingly, the added amount of the electrically-conductive ceramic is preferably determined taking into account the durability of the ceramic substrate 5, etc.

Figure 8:
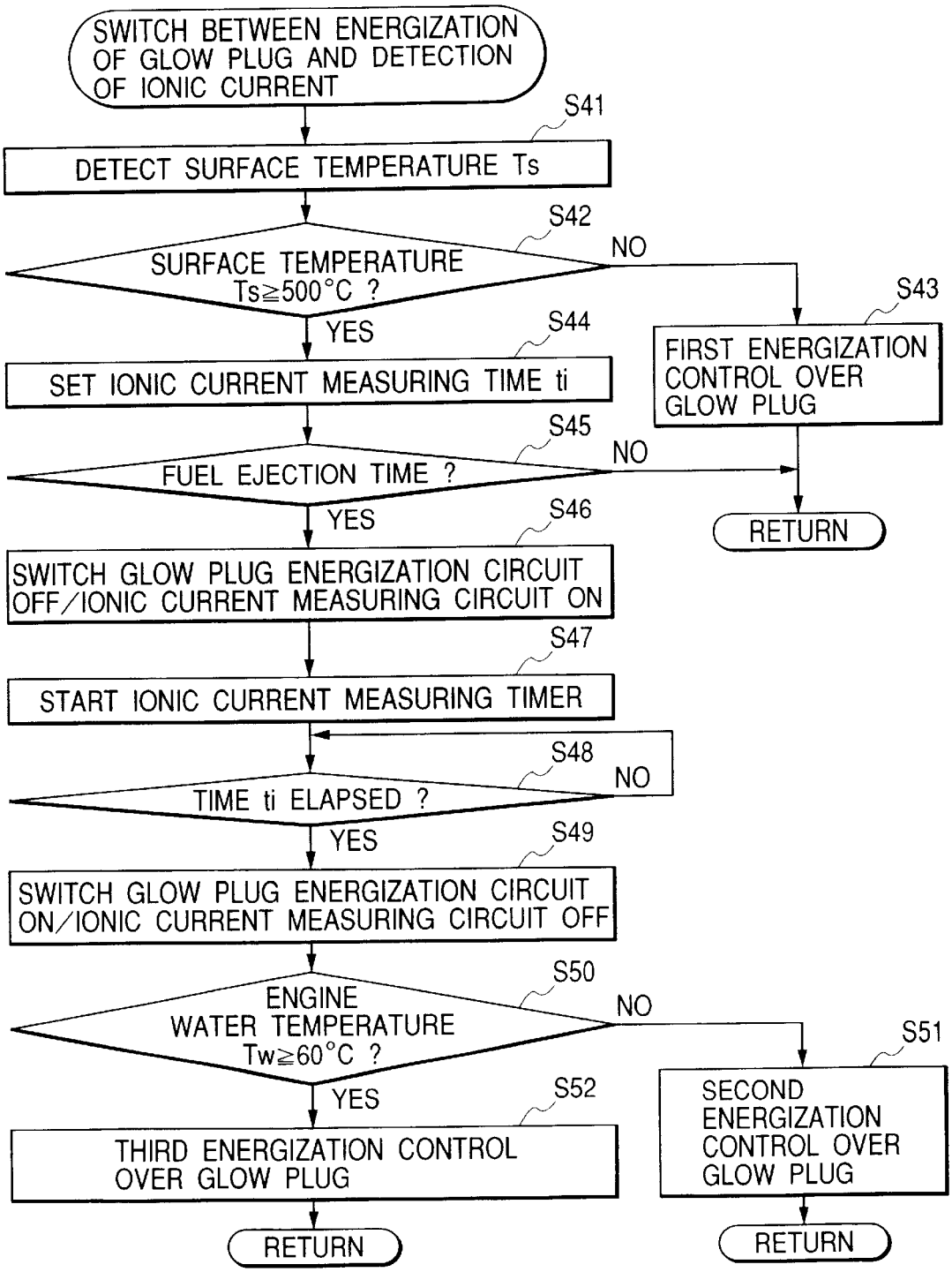
FIG. 8 is a flow chart illustrating the control performed by the glow plug control apparatus according to the embodiment

The flow chart of control of the glow plug control apparatus 100 according to the present embodiment is shown in FIG. 8. This control is performed throughout both the stage before and after the completion of warming-up of the engine. The switching between the energization of glow plug and the detection of ionic current shown in this flow chart is performed for main routine (not described in detail) in ECU 105 by interrupt at proper intervals. In the initial stage, when the glow plug energization circuit is ON, i.e., in the circuit shown in FIG. 5, the switch 102 is connected to the battery 101 (lower side as shown in the drawing) while the switch 103 is switched ON (circuit closed).

When this process starts, ECU 105 detects the surface temperature Ts of the forward end 2*a* of the glow plug 10 at the step S41. In some detail, the heating element resistivity Rg is determined from the voltage Vg applied to the glow plug 10 and the resulting current Ig. The surface temperature Ts is then estimated from the heating element resistivity Rg.

Subsequently, at the step S42, it is judged whether the surface temperature Ts is not lower than 500° C. If Ts is lower than 500° C. (No) i.e., if the temperature of the glow plug 10 is not sufficiently raised as in the initial stage such as pre-glow stage, the process proceeds to the step S43. At the step S43, first energization control over glow plug is conducted such that the surface temperature Ts of the forward end 2*a* reaches not lower than 500° C.

Figure 9A:
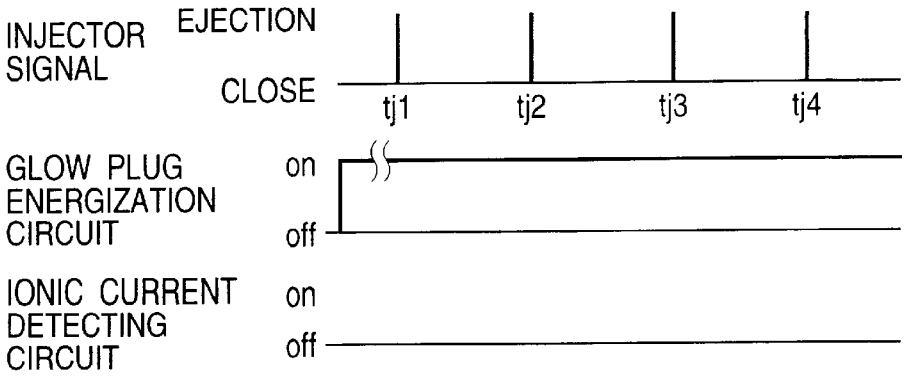
FIGS. 9A to 9C are timing charts illustrating the relationship between the fuel injection timing and the state of being controlled in glow plug energization and state of being controlled in ions where FIG. 9A indicates data obtained during pre-glow period, FIG. 9B indicates data during after-glow period after actuation and FIG. 9C indicates data during normal operation.

In some detail, control as shown in FIG. 9(*a*) is conducted. In other words, regardless of injector signal inputted to the fuel injection valve 33, the glow plug energization circuit is switched ON to energize the glow plug 10. On the other hand, the ionic current detection circuit is switched OFF so that the detection of ions is not conducted. This is intended to raise the temperature of the glow plug, which has not been sufficiently raised, as soon as possible and hence allow the actuation of the engine 30. Further, since the surface temperature Ts is low, the resisitivity Ri of the ceramic substrate 5 is too great to conduct the measurement of ionic current Ii.

After the first energization control over glow plug at the step S43, the process proceeds to main routine.

On the other hand, if Ts is not lower than 500° C. at the step S42, the process proceeds to the step S44 where the time ti of measuring ionic current Ii is then set. In some detail, the time ti is selected and set depending on the engine rotary speed Nr and load L detected by ECU 105. This is intended to measure ionic current Ii for a proper period of time depending on the time lag td based on the fuel injection tine tj1 or the like or the time tc of continuation of waveform of ionic current which varies with the engine rotary speed Nr or load L (see FIG. 6) In more detail, the time ti may be read out from the engine rotary speed Nr and load L in a look-up table prepared and stored in ROM of ECU 105 by which the time ti is given. Alternatively, data substitute for load L such as accelerator opening and accelerator position may be used. Further, regardless of load L, time ti represented by a constant value (e.g., 90° CA) as calculated in terms of crank angle may be selected.

Subsequently, the process proceeds to the step S45 to judge to see if it is in the fuel injection period. In some detail, detection is made to see if the injector signal from the fuel injection valve 33is at timing tj1, tj2 . . . indicating injection command (high). If the injector signal is not at the fuel injection time tj1 (No), the process returns to main routine.

Figure 9B:
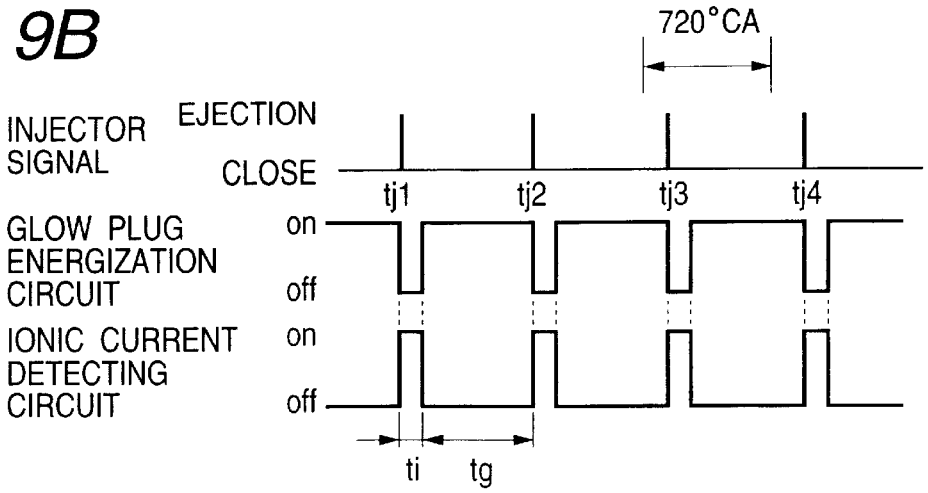
Figure 9C:
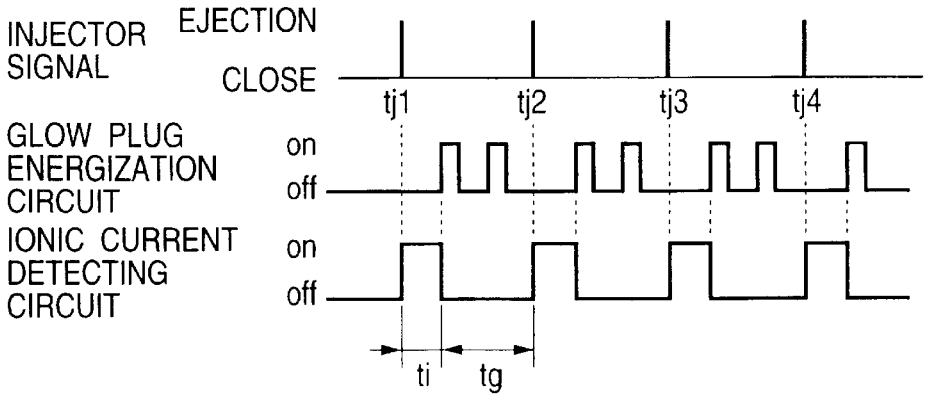

Thereafter, when the injector signal is at the timing tj1 or the like (Yes), the process proceeds to the step S46 where when the injector signal is at the timing indicating injection command (high) as shown in FIGS. 9B and 9C, the switches 102, 103 are operated to switch the glow plug energization circuit Off and the ionic current measuring circuit ON. In some detail, the switch 102 is connected to the constant voltage power supply 106 (upper side as shown in the drawing) while the switch 103 is switched OFF (circuit opened). In this manner, ionic current Ii can be measured between the exposed portion 2*d* of the glow plug 10 and the cylinder head 31, making it possible to detect if the fuel is ignited in the engine or the time of ignition and hence help control the engine 30.

The process further proceeds to the step S47 where an ionic current measuring timer is allowed to start. Thereafter, at the step S48, the passage of the ionic current measurement time ti which has been set at the step S44 is awaited.

When the time ti is passed (Yes), the process proceeds to the step S49 where after the lapse of time ti from the fuel injection time tj1 or the like as shown in FIGS. 9B and 9C, the switches 102, 103 are then operated to switch the ionic current measuring circuit OFF and the glow plug energization circuit ON. In some detail, the switch 102 is connected to the battery 101 (lower side as shown in the drawing) while the switch 103 is switched ON (circuit closed). In this manner, the measurement of ionic current Ii is terminated, making it again possible to allow the ceramic heating element 4 of the glow plug 10 to generate heat.

Thereafter, ECU 105 judges at the step S50 to see if the temperature Tw of water in the engine is not lower than a predetermined temperature (not lower than 60° C. in the present embodiment). In other words, it is judged to see if the engine 30 has been warmed up.

If the water temperature Tw is low (Tw<60° C.) (No), it is judged that the warming-up of the engine has not yet been completed. Therefore, the process proceeds to second energization control over glow plug (step S51) where after the lapse of time ti from the fuel injection time tj1 or the like as shown in FIG. 9(*b*), the energization of the glow plug 10 is continued for a period of time tg until the subsequent fuel injection time tj2, and so on. Accordingly, ionic current can be measured. Further, the second energization control over glow plug allows the surface temperature Ts of the forward end 2*a* (exposed portion 2*d*) of the glow plug 10 to be kept to not lower than 500° C. and even raised to higher than 500° C., e.g., as high as not lower than 800° C., making it possible to continue pre-glow and after-glow operation.

In the after-glow stage after the actuation of the engine 30, the surface temperature Ts of the glow plug 10 may be kept to a range of from 800° C. to 900° C. Therefore, in the period tg, the switch 103 may be switched ON or Off as in the step S52 to control the temperature of the glow plug 10.

On the other hand, if the water temperature Tw is high (Tw≧60° C.) (Yes), it is judged that the warming-up of the engine has been completed. Therefore, the process proceeds to third energization control over glow plug (step S52) where after the lapse of time ti from the fuel injection time tj1 or the like as shown in FIG. 9C, pulse energization of the glow plug 10 is conducted such that the surface temperature Ts is kept to not lower than 500° C. for a period of time tg until the subsequent fuel injection time tj2, and so on.

The pulse energitation of the glow plug 10 is conducted since the warming-up of the engine 30 has been completed to eliminate the necessity of keeping the temperature of the glow plug 10 to so high as in the pre-glow stage or after-glow stage. The pulse energization of the glow plug 10 suffices if the surface temperature Ts is kept to an extent such that ionic current Ii can be measured using the glow plug 10 (Ts≧500° C.). On the other hand, if the surface temperature of the glow plug 10 is continuously kept to an extremely high temperature, the deterioration of the glow plug 10 is accelerated. Thus, the surface temperature Ts is preferably lowered. The pulse energization of the glow plug 10 is intended to reduce the power to be consumed to energize the glow plug 10 (ceramic heating element 4), preventing the reduction of fuel economy.

In some detail, by causing ECU 105 to switch the switch 103 ON or OFF in response to a command signal, the period during which the glow plug 10 (ceramic heating element 4) is energized within the period tg is adjusted to keep the surface temperature Ts of the forward end 2*d* (exposed portion 2*d*) to not lower than a proper value of not lower than 500° C. (e.g., 700° C.). Accordingly, also in the subsequent processing, the surface temperature Ts is judged to be not lower than 500° C. at the step S42, making it possible to alternatively continue the measurement of ionic current Ii and the heating of the glow plug 10. In this manner, the ionic current Ii thus measured can be used to control the engine 30 as well as lessen the vibration and noise and clean the exhaust gas.

As described in connection with FIG. 7, the surface temperature Ts of the forward end 2*a* (exposed portion 2*d*) can be not lower than 500° C. (800° C. at highest in the graph of FIG. 7) even if the glow plug 10 is not energized depending on the rotary speed Nr of the engine 30 or the load L on the engine 30. Accordingly, under the driving conditions such that the surface temperature Ts is raised, it is likely that the glow plug 10 cannot be energized within the period tg.

At the step S50, water temperature Tw is used to make judgment. However, once the water temperature Tw exceeds a predetermined temperature (e.g., 60° C.), a flag may be set as completion of warming-up. The conditions of the flag can be used to make judgment.

The glow plug control apparatus 100 according to the present embodiment switches the switches 102, 103 to perform the energization of the glow plug and the measurement of ionic current. Accordingly, in the initial stage of pre-glow period where the surface temperature Ts is low, the glow plug 10 can be energized without measuring ionic current Ii to rapidly raise the temperature thereof. When the surface temperature Ts exceeds 500° C., the measurement of ionic current Ii is performed during a certain period of time ti from the fuel injection time tj1 or the like. After the lapse of this time ti, the energization of the glow plug 10 is controlled. Accordingly, in the stage after pre-glow and during after-flow, the ignition and combustion of fuel in the engine can be accelerated by the heat generation of the glow plug 10. Further, by measuring ionic current Ii, the engine can be controlled. Moreover, even after the completion of warming-up, by keeping the surface temperature Ts of the forward end 2*a* (exposed portion 2*d*) of the glow plug 10 to not lower than 500° C., the ignition and combustion of fuel can be stabilized, making it possible to lessen the vibration and noise and clean the exhaust gas. Further, by measuring ionic current Ii, the engine can be controlled.

(Embodiment 2)

The second embodiment of implication of the present invention will be described hereinafter. In the foregoing embodiment 1, the surface temperature Ts of the forward end

2*a* is estimated from the resistivity Rg of the ceramic heating element 4 to make detection (step S41). By judging to see if the surface temperature Ts is not lower than 500° C., it is judged (at step S42) which the process proceeds to the first energization control over glow plug (step s43) or the measurement of ionic current (step S44 and after).

The embodiment 2 differs from the embodiment 1 only in that the resistivity Rg of the ceramic heating element 4 is used to make control but has the same configuration of glow plug 10 and glow plug control apparatus 100 as in the embodiment 1. Therefore, different parts will be described. The description of the same parts will be omitted or simplified. In the present embodiment, too, controlling is performed throughout both the stage before and after the completion of warming-up of the engine.

Figure 10:
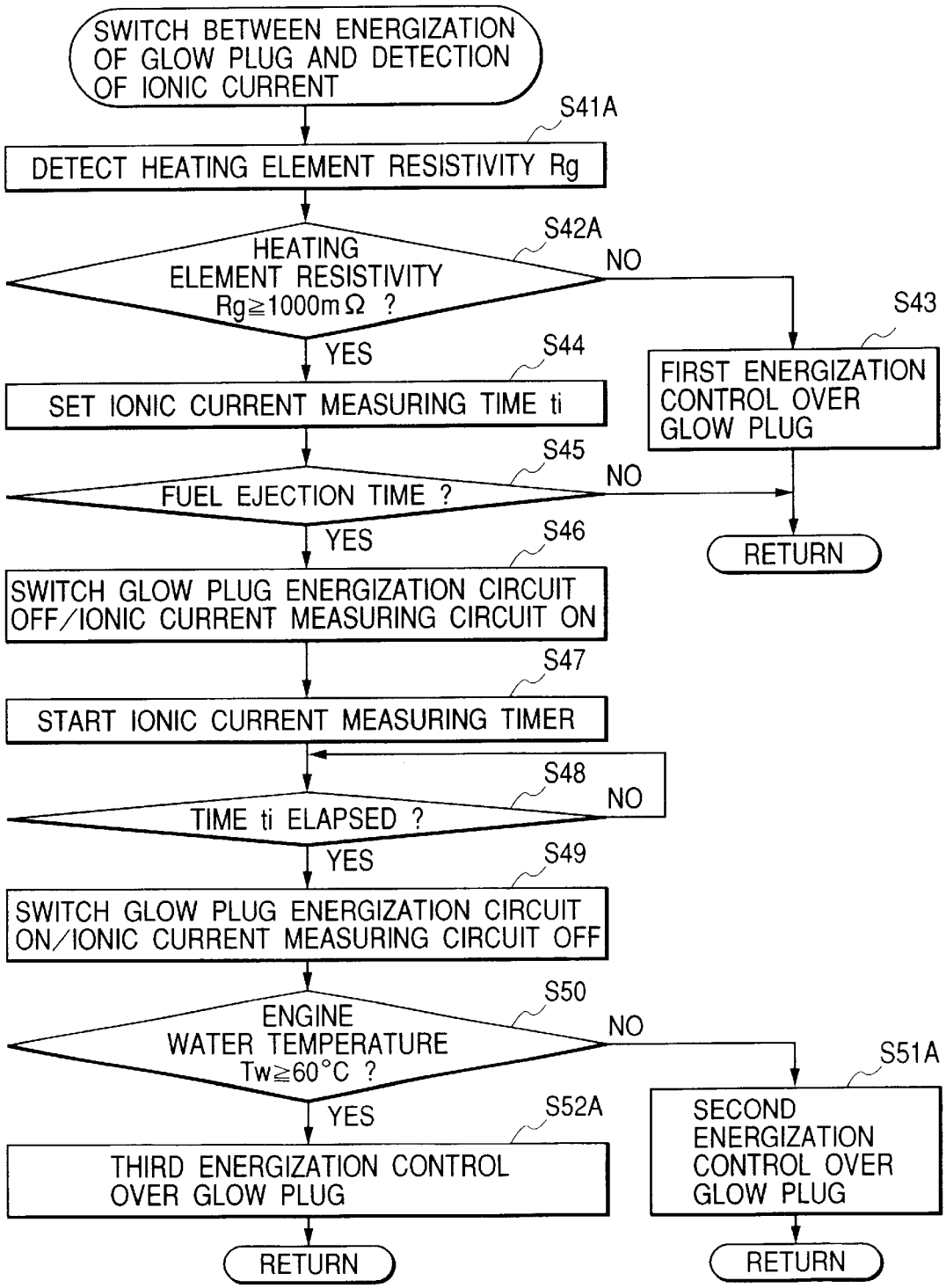
FIG. 10 is a flow chart illustrating the control performed by the glow plug control apparatus according to the embodiment 2.

The control performed by the glow plug control apparatus according to the embodiment 2 is shown in FIG. 10 This flow chart is almost the same as the flow chart of the embodiment 1 except that the steps S41A, 42A, 51A and 52A differ from that of the embodiment 1.

When the processing starts, ECU 105 determines the resistivity Rg of the ceramic heating element 4 from the voltage Vg applied to the glow plug 10 and the resulting current Ig at the step S41A.

Subsequently, at the step S42A, it is judged whether the heating element resistivity Rg is not lower than 1,000 mΩ. As described in the embodiment 1, there is a relationship shown in FIG. 4 between the resistivity Rg of the ceramic heating element 4 and the surface temperature Ts. Accordingly, judgment is made to see if Rg is not lower than 1,000 mΩ, which corresponds to Ts of not lower than 500° C. If Rg is lower than 1,000 mΩ (No) , i.e., if the glow plug 10 has not been sufficiently heated as in the initial stage of pre-glow period, the process proceeds to the step S43. At the step S43, first energization control over glow plug is performed such that the heating element resistivity Rg not lower than 1,000 mΩ, i.e., the surface temperature Ts of the forward end 2*a* reaches not lower than 500° C.

On the other hand, at the step S42A, if Rg is not lower than 1,000 mΩ (Yes), the process proceeds to the step S44 and after where the measurement of ionic current Ii is then performed in the same manner as in the embodiment 1.

If the water temperature Tw is lower than 60° C. (No) as a result of judgment at the step S50 to see if the temperature of water in the engine is not lower than 60° C., i.e., the engine 30 has been warmed up, it is then judged that the warming-up of the engine has not been completed. Then, the process proceeds to the second energization control over glow plug (step S51A), At the step S51A, too, as shown in FIG. 9B, the energization of the glow plug 10 is continued for a period of time tg after the lapse of time ti from the fuel injection time tj1 until the subsequent fuel injection time tj2, and so on. Accordingly, the measurement of ionic current can be performed. Further, the second energization control over glow plug allows the glow plug 10 to be energized, making it possible to keep the heating element resistivity Rg to not lower than 1,000 mΩ and even raise it to higher than 1,000 mΩ. In this manner, pre-glow and after-glow can be continued.

On the other hand, if the water temperature Tw is not lower than 60° C. (Yes), it is judged that the warming-up of the engine has been completed. Then, the process proceeds to the third energization control over glow plug (step S52A) where after the lapse of time ti from the fuel injection time tj1 or the like as shown in FIG. 9C, pulse energization of the glow plug 10 is conducted such that the heating element resisitivity Rg is kept to not lower than 1,000 mΩ for a period of time tg until the subsequent fuel injection time tj2, and so on.

In some detail, by causing ECU 105 to switch the switch 103 ON or OFF in response to a command signal, the period during which the glow plug 10 (ceramic heating element 4) is energized within the period tg is adjusted to keep the heating element resisitivity to not lower than 1,280 mΩ, which corresponds to the surface temperature Ts of not lower than 700° C. Accordingly, also in the subsequent processing, the heating element resistivity Rg is judged to be not lower than 1,000 mΩ at the step S42A, making it possible to alternatively continue the measurement of ionic current Ii and the heating of the glow plug 10. In this manner, the ionic current Ii thus measured can be used to control the engine 30 as well as lessen the vibration and noise and clean the exhaust gas.

In the foregoing manner, the energization control over the glow plug 10 can be performed as in the embodiment 1. Further, since it is not necessary that the heating element resistivity Rg be converted to the surface temperature Ts at the step S41 or the like, processing can be performed more easily. Accordingly, in the initial stage of pre-glow period, the glow plug can be energized without measuring ionic current Ii to rapidly raise the temperature thereof. On the other hand, in the stage after pre-glow and during after-flow, the ignition and combustion of fuel in the engine can be accelerated by the heat generation of the glow plug 10. Further, by measuring ionic current Ii, the engine can be controlled. Moreover, even after the completion of warming-up, the heating element resistivity Rg of the glow plug 10 is kept to not lower than 1,000 m Ω particularly to not lower than 1,290 mΩ. In this manner, the surface temperature Ts of the forward end 2*a* (exposed portion 2*d*) can be kept to not lower than 500° C., particularly to not lower than 700° C. Thus, the ignition and combustion of fuel can be stabilized, making it possible to lessen the vibration and noise and clean the exhaust gas. Further, by measuring ionic current Ii, feedback control over engine such as timing and amount of fuel injection can be performed.

Since the voltage Vg across the positive and negative electrodes of the battery 101 varies greatly with the ambient temperature or degree of consumption, the voltage Vg measured at the voltmeter 112 is used to determine the heating element resistivity Rg. However, if the voltage Vg of the battery 112 is considered to be constant, the heating element resistivity Rg and the current Ig are inversely proportional to each other (Rg=Vg/Ig; Vg=constant). Therefore, the current Ig may be used to control the glow plug 10 without determining the heating element resistivity Rg.

(Embodiment 3)

The third embodiment of implication of the present invention will be described hereinafter. In both the foregoing embodiments 1 and 2, the relationship between the resistivity Rg of the ceramic heating element 4 of the glow plug 10 and the surface temperature Ts of the exposed portion 2*a* is made the use of to perform controlling. On the contrary, the present embodiment is the same as the first and second embodiments except that it differs from the first and second embodiments in that a thermocouple is formed in the ceramic substrate of the glow plug separately of the ceramic heating element so that the temperature of the exposed portion can be directly measured. The other parts is equal to the foregoing embodiments, and different parts will be described.

Figure 11:
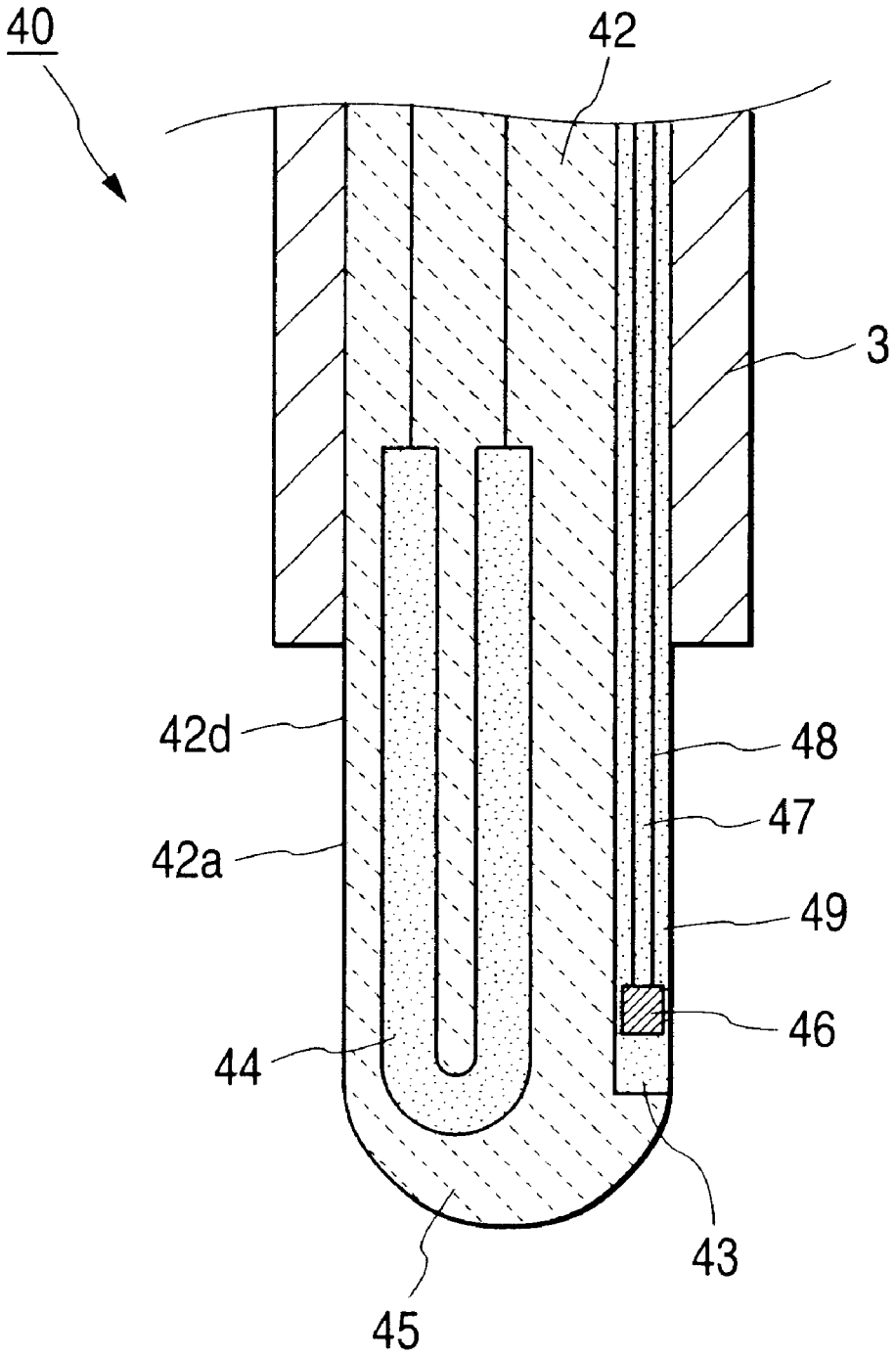
FIG. 11 is a diagram illustrating the configuration of the forward end of the glow plug according to the embodiment 3.

Referring to the forward end portion in connection with FIG. 11, the ceramic heater 42 is brazed to the outer cylinder 3. In the embodiment 3, a U-shaped ceramic heating element 44 is provided at the forward end 42*a* of the ceramic heater 42. And, an R thermocouple 46 comprising lead wires 47, 48 welded at the end thereof embedded by a cement 49 is provided in a groove 43 formed axially (vertically as shown in the drawing) on the periphery of the ceramic substrate 45. In accordance with the glow plug 40 having the foregoing configuration, when the ceramic heating element 44 is energized to generate heat, the temperature of the area having the temperature extremely close to the surface temperature Ts of the forward end 42*a* can be directly measured. Accordingly, the use of the glow plug 40 having the foregoing configuration makes it possible to measure the surface temperature Ts more accurately than estimated from the resistivity Rg of the ceramic heating element 4 as in the embodiment 1 in order to control the glow plug 40. The control over the glow plug 40 can be made in the same manner as in the embodiment 1 at the steps S41 and S42 (see FIG. 8), except that the output of R thermocouple 46 is used to determine the surface temperature Ts by which judgment is then made.

While the present invention has been described hereinabove with reference to the embodiments 1 to 3, it is not limited thereto. It goes without saying that various changes and modifications can be made therein without departing from the spirit and scope thereof.

For example, the foregoing embodiments have been described with reference to the circuit configuration having the battery 101 as well as the constant voltage power supply 108 to be added to measure ionic current Ii (see FIG. 5). However, by properly selecting the resistivity Rd of the detection resistor or the resistivity Ri of the ceramic substrate 5, only the battery 101 can be used to form a circuit configuration capable of heating the glow plug 10 and measuring ionic current.

As the compositions of the ceramic substrate 5 of the glow plug there were prepared the five compositions set forth in Table 1. However, it is apparent that other compositions of ceramic substrate can be used to realize the glow plug.

Examples of the electrically-conductive ceramic employable herein include the foregoing TiN, TiC, WC, $MoSi_2$ and SiC, and silicide, carbide, boride and nitride of W, Ta, Nb, Ti, Zr, Hf, V and Cr such as ZrN, TaN, TiSi2, $CrSi_2$ and $WSi_2$.

As a sintering aid there may be used $Al_2O_3$, $Er_2O_3$, $V_2O_3$, $WO_3$, $Y_2O_3$ or the like besides $Yb_2O_3$ and $Cr_2O_3$ used in the present embodiment.

What is claimed is:

1. A glow plug control apparatus comprising:

a glow plug comprising a housing fixed to an engine, a heating element insulated from said housing which generates heat when energized by electric current supplied through two conductive paths at least either before or after the completion of warming-up of said engine and a ceramic heater having an exposed portion which is heated by said heating element and exposed to the interior of the combustion chamber of said engine;

a glow plug energization controlling means for controlling the energization of said heating element of said glow plug depending on the surface temperature of said exposed portion so as to raise or keep said surface temperature to not lower than a predetermined temperature;

an ion detecting means for detecting ions in said combustion chamber using said glow plug;

a switching means for switching the state of said glow plug from the state of being controlled in energization by said glow plug energization controlling means to the state of ion detection by said ion detecting means or vice versa; and a switching command means for commanding the switching from the state of being controlled in energization to the state of ion detection by said switching mans for a predetermined period of time from the time of injection of fuel into said combustion chamber when the surface temperature of said exposed portion is not lower than said predetermined temperature.

2. The glow plug control apparatus according to claim 1, wherein said predetermined temperature is selected from the range of from 500° C. to 900° C.

3. The glow plug control apparatus according to claim 2, wherein said heating element of said glow plug is covered by a ceramic substrate and the resistivity of the substrate between said heating element and the surface of said ceramic substrate is from 10 kΩ to 1 gΩ when the surface temperature of said exposed portion is from said predetermined temperature to 1,200° C.

4. A glow plug control apparatus comprising:

a glow plug comprising a housing fixed to an engine, an heating element insulated from said housing which generates heat when energized by electric current supplied through two conductive paths at least either before or after the completion of warming-up of said engine and a ceramic heater having an exposed portion which is heated by said heating element and exposed to the interior of the combustion chamber of said engine;

a glow plug energization controlling means for controlling the energization of said heating element of said glow plug depending on the resistivity of said heating element so as to raise or keep said resistivity to not lower than a predetermined resistivity;

an ion detecting means for detecting ions in said combustion chamber using said glow plug;

a switching means for switching the state of said glow plug from the state of being controlled in energization by said glow plug controlling means to the state of ion detection by said ion detecting means or vice versa; and a switching command means for commanding the switching from the state of being controlled in energization to the state of ion detection by said switching means for a predetermined period of time from the time of injection of fuel into said combustion chamber when the resistivity of said heating element is not lower than said predetermined resistivity.

5. A glow plug comprising a housing, and a heating element insulated from said housing which generates heat when energized by electric current supplied through two conductive paths, wherein said heating element includes a ceramic heater covered by a ceramic substrate and the resistivity of the substrate between said heating element and the surface of said ceramic substrate is from 10 kΩ to 1 GΩ when the surface temperature of the forward end of said ceramic heater is from 500° C. to 1,200° C.

6. A method of detecting ions in the combustion chamber of an engine to which a glow plug is fixed, the glow plug comprising a housing, a heating element insulated from said housing which generates heat when energized by electric current supplied through two conductive paths and a ceramic heater having an exposed portion which is heated by said heating element and exposed to the interior of the combustion chamber, the method comprising a step of:

controlling the energization of said heating element of said glow plug while said engine is being warmed up, depending on the resistivity of said heating element so as to raise or keep said resistivity to not lower than a predetermined resistivity; and detecting ions in said combustion chamber by said glow plug switched from said state of being controlled in energization to said state of ion detection, for a predetermined period of time from the time of injection of fuel into said combustion chamber for detecting ions in said combustion chamber, when the resistivity of said heating element is not lower than said predetermined resistivity.

* * * * *